United States Patent [19]

Bianchi

[11] Patent Number: 4,487,144

[45] Date of Patent: Dec. 11, 1984

[54] SEWING MACHINE PIVOTABLE WORK SUPPORT

[75] Inventor: Nereo Bianchi, Pavia, Italy

[73] Assignee: NECCHI Societa per Azioni, Pavia, Italy

[21] Appl. No.: 426,954

[22] Filed: Sep. 29, 1982

[30] Foreign Application Priority Data

Jan. 19, 1982 [IT] Italy ..... 42901 A/82

[51] Int. Cl.[3] ..... D05B 73/10

[52] U.S. Cl. ..... 112/260; 16/225

[58] Field of Search ..... 112/260; 16/225, 387; 108/45, 46, 63, 130; 312/232, 281, DIG. 33

[56] References Cited

U.S. PATENT DOCUMENTS

| | | | |
|---|---|---|---|
| 2,210,972 | 8/1940 | Christenson | 108/130 X |
| 2,673,776 | 3/1954 | Barnhart | 108/63 X |
| 3,202,310 | 8/1965 | Tibbets | 16/225 X |
| 3,344,762 | 10/1967 | Szostak et al. | 112/260 |
| 3,773,381 | 11/1973 | Brennan | 108/45 X |
| 4,314,517 | 2/1982 | Kasahara et al. | 112/260 |
| 4,421,043 | 12/1983 | Kornatowski et al. | 112/260 |

*Primary Examiner*—Werner H. Schroeder
*Assistant Examiner*—Andrew M. Falik
*Attorney, Agent, or Firm*—Stevens, Davis, Miller & Mosher

[57] ABSTRACT

A transformable sewing surface for sewing machines formed of a base consisting of a first section having an upper and lower surface, a second section containing stitch-forming members, extending parallel to the first section and spaced from it, and a platform connected to said first section so as to swing with respect to it in order to assume two positions, in the first of which it is located in the space present between the sections of the base so as to form a continuous sewing surface with it while in the second position it turns with respect to the first section so as to leave the second section free, the connection of the platform being provided with hinges of flexible material by means of which the platform can turn so as to be swung from the first position in which it rests on the lower surface of the first section to the second position where the platform rests on the upper surface of the first section.

3 Claims, 3 Drawing Figures

SEWING MACHINE PIVOTABLE WORK SUPPORT

A sewing surface for a sewing machine of the household type which can be transformed from a flat base to a free arm by use of a platform hinged to one section of the base and resting on a lower plane thereof so as to fill the space between the first section of the base and the free arm containing the stitch-forming members in order to constitute a continuous sewing surface. This platform is swung 180° to leave the arm free for the sewing of pieces of fabric of tubular shape.

In the bottom part of the platform there are provided suitable compartments in which various accessories of the sewing machine are housed.

DESCRIPTION OF THE INVENTION

The present invention relates to a transformable sewing surface for sewing machines and more particularly to improvements made in systems for transforming the machine from a flat base to a cylindrical arm.

Various solutions designed for this purpose are at present on the market, in which between the cylindrical arm of the machine which contains the hook and the fixed portion of the base of the machine a platform can swing downwardly, hinged to the fixed portion, to leave the cylindrical arm free and in this way make it possible to sew on tubular pieces such as the sleeves of shirts and other similar pieces. These solutions are of complex construction which increases the cost of production of the machine.

The object of the present invention is to improve the systems now in use, so as to make them more rational and simpler.

The technical problem to be solved in order to achieve the above-indicated purpose was to find a new arrangement of the platform already used in the known art so as to impart to the system practicality and rationality in its operation and give it the ability to perform additional functions.

This technical problem was solved by providing the hinges of flexible material, connecting the platform to the fixed base of the machine, so that the platform can be folded from a first position into a second position in which it rests on an upper surface of a section of the base. A lower surface is provided on the first section of the base on which the flap rests in part when it is in its first position of operation.

Other details and features of the invention will stand out from the description given below by way of non-limitative example and with reference to the accompanying drawings, in which.

Figure 1:
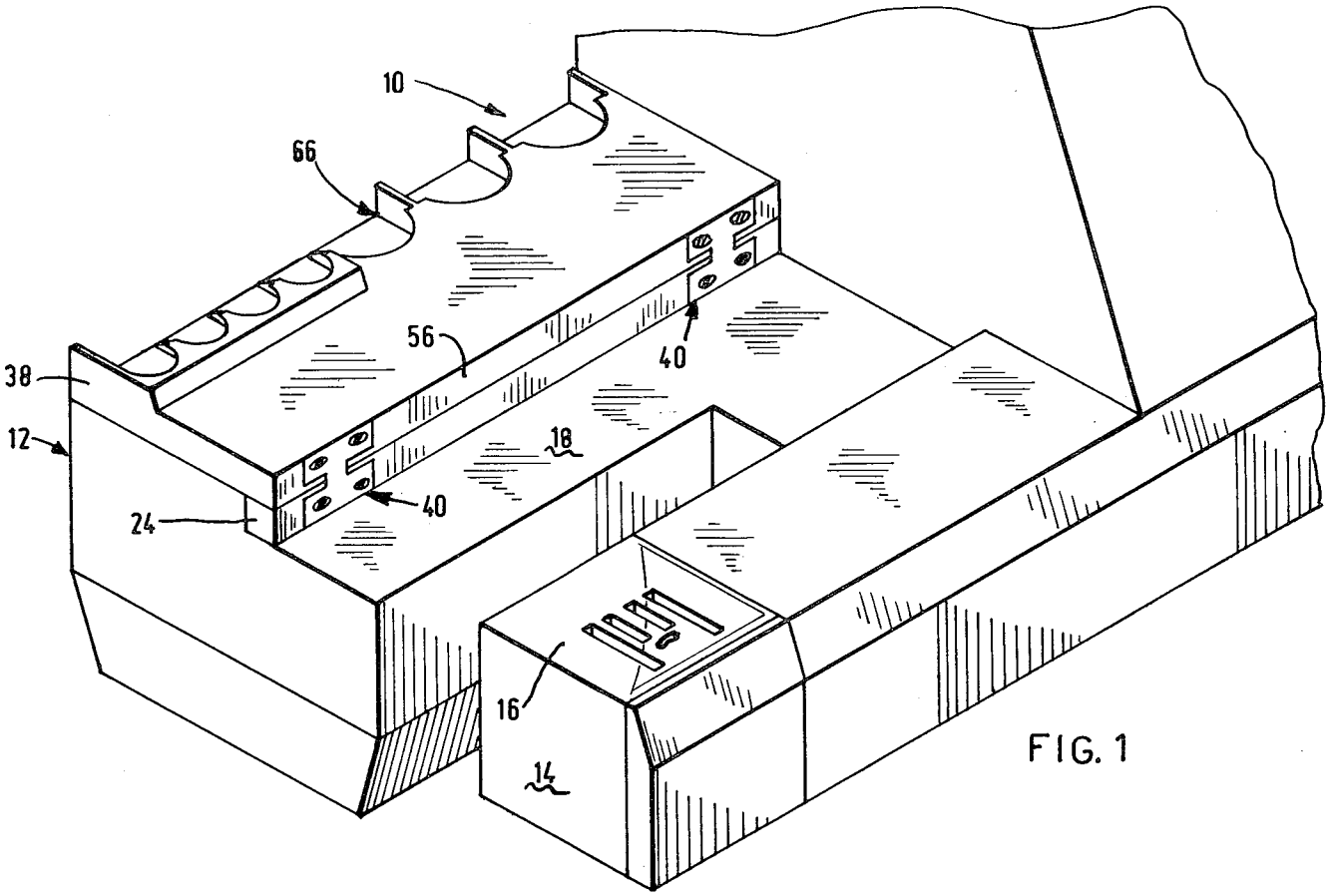
FIGS. 1 and 2 show the sewing surface, in perspective view, in its two operating positions, namely free arm and flat base.
Figure 2:
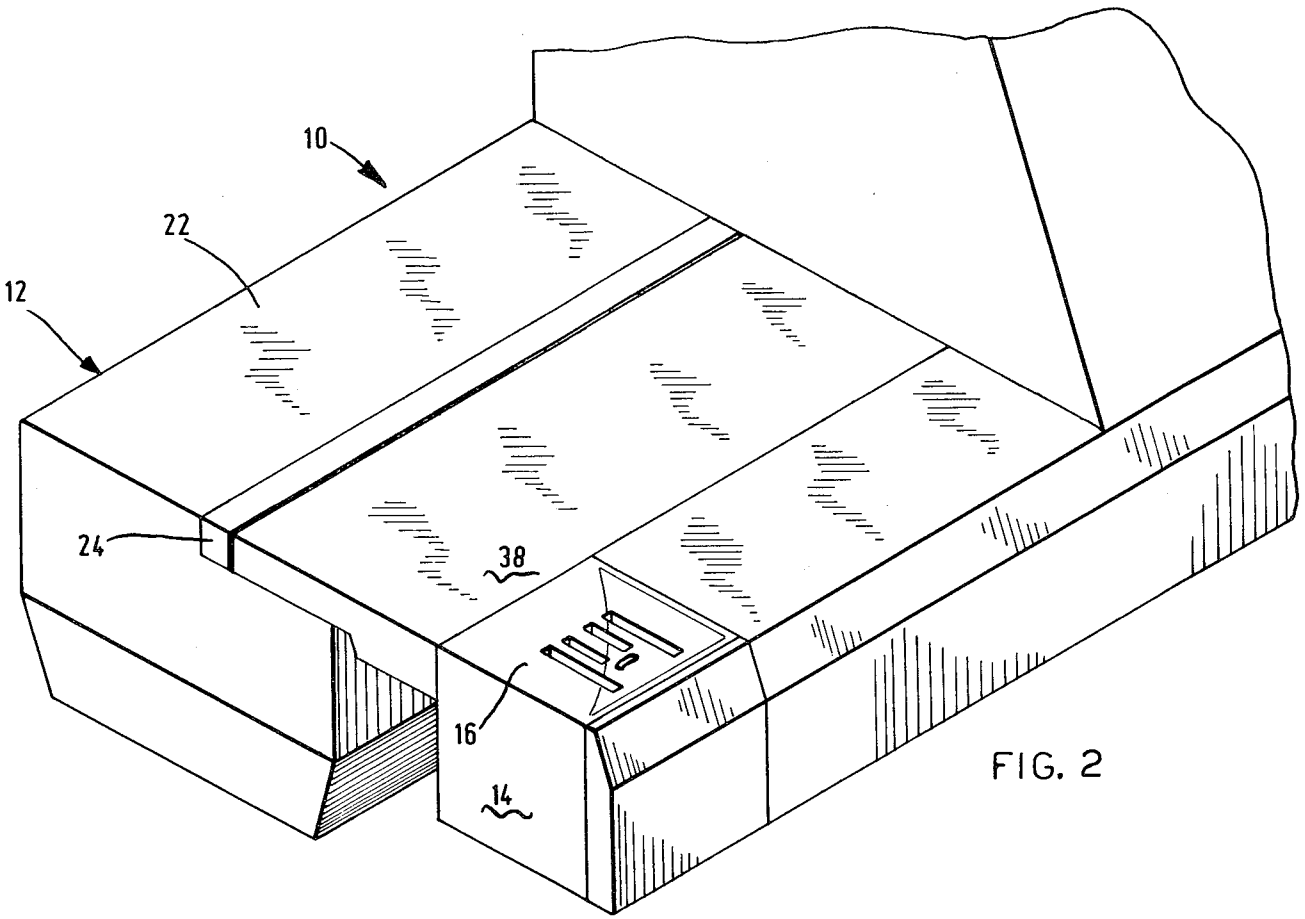

Referring to FIGS. 1 and 2, 10 is the base of a sewing machine formed of a first section 12 and a second section 14 which is parallel to the first section and of equal length.

Within the second section there are contained the stitch-forming members (not described or shown) namely the hook, the fabric feeder dog and the mechanical parts which transmit the motion thereof. At the end of the section 14, on its upper surface, there is placed in customary manner the needle plate 16.

Figure 3:
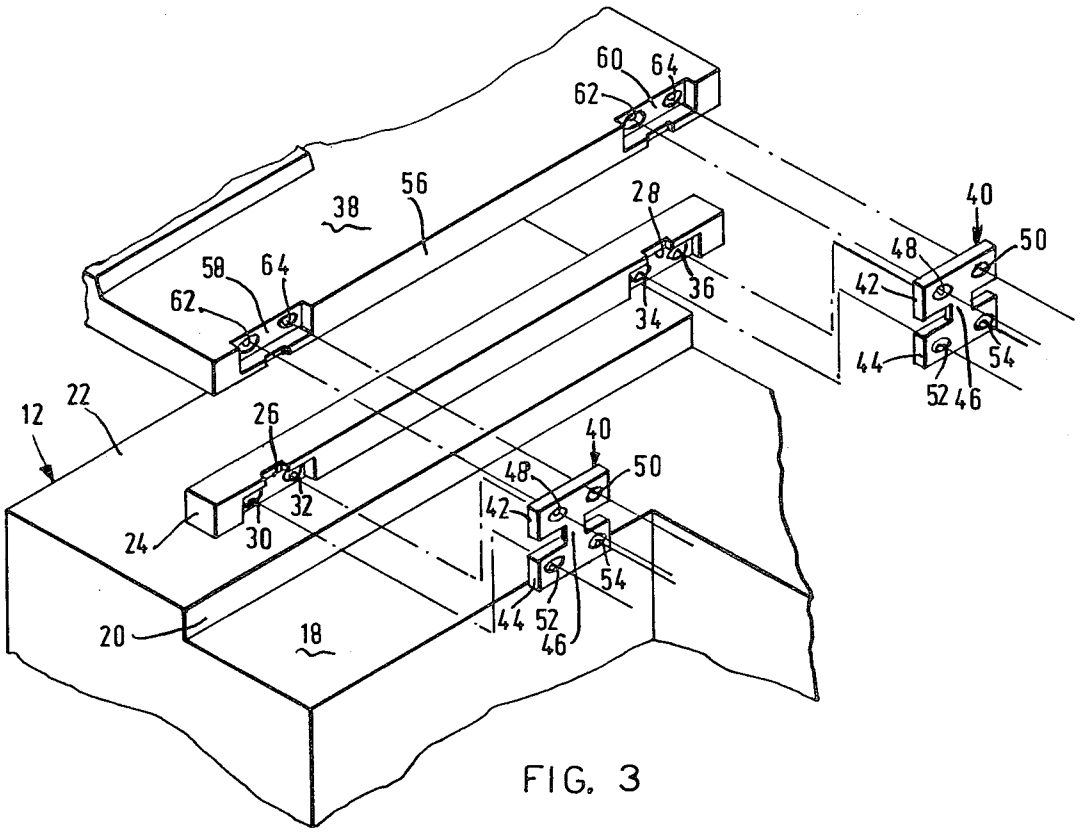
FIG. 3 shows structural details of the system for the transformation of the sewing surface shown in FIGS. 1 and 2.

The section 12 of the base is provided along its entire length with a lower surface 18 (FIG. 1). Against a vertical wall 20 which connects the surface 18 to the flat surface 22 of section 12 there rests a strip 24 in the form of a parallelepiped, made preferably of plastic material. The lower surface of strip 24 is fastened by customary means to surface 18. Strip 24, which has a smaller tranverse length than the surface 18 is provided with two spaced recesses 26, 28 (FIG. 3) each of which is provided with two holes 30, 32 and 34, 36 respectively. A platform 38 of rectangular shape is connected by suitable hinges 40 to the strip 24 and is so dimensioned that when it assumes the horizontal position shown in FIG. 2 it rests on the remaining part of lower surface 18 and completely fills the space present between the two sections 12 and 14 of the base 10, forming a continuous sewing table with the upper surfaces thereof. When parts of clothing of tubular shape are to be sewn, the platform 38 is swung 180° (FIG. 1) so as to leave the cylindrical arm portion 14 of the base 10 free.

In accordance with the concept of the invention, the hinges 40 are formed of flexible plastic material. Each of which has two rectangular portions 42 and 44 which are connected together by a tongue-shaped portion 46. Holes 48 and 50 and 52, 54 are provided through the portions 42 and 44 respectively and serve to connect the platform 38 to the strip 24. For this purpose the vertical wall 56 of the platform 38 is provided with recesses 58 and 60 (FIG. 3) which are identical to the recesses 26 and 28 provided in the strip 24 and like the strip 24 are provided with holes 62, 64.

By means of suitable screws the portions 42 and 44 of the hinges 40 are connected to the platform 38 and the strip 24 respectively, in such a manner that the portions 42 and 44 are completely contained within their respective recesses 58, 60 and 26, 28.

Thus, when the platform 38 is placed horizontally as in FIG. 2, the flat sewing base which is thus formed has no particular interruption along the line of separation between the strip 24 and the the flap.

In accordance with another feature of the invention, the bottom of the flap 38 (FIG. 1) bears suitable compartments 66 within which some accessories for the sewing machine are contained, such as bobbins, envelopes of needles, shuttle-closing disks and others, whose dimensions are adapted to permit placing them within the the compartments 66.

I claim:

1. A transformable sewing surface for sewing machines formed of a base consisting of a first section having an upper and lower surface, a second section containing stitch-forming members, extending parallel to said first section and spaced from it, and a platform connected to said first section so as to swing with respect to it in order to assume two positions, in the first of which it is located in the space present between said sections of the base so as to form a continuous sewing surface with it while in the second position it turns with respect to said first section so as to leave said second section free, said connection of said platform being provided with hinges of flexible material by means of which the platform can turn 180° as to be swung from said first position in which it rests on the lower surface of said first section to said second position where said flap rests on the upper surface of said first section.

2. The sewing surface for sewing machines according to claim 1, wherein said platform defines suitable compartments in its lower side when in its first position and in its upper side when in its second position thereby allowing operator easy access to accessories in which accessories of the sewing machine may be placed.

3. The sewing surface for sewing machines according to claim 1, wherein said hinges of flexible material are formed of two rectangular portions connected together by a tongue, one of said portions being fastened to said platform and the other to a strip which in its turn is fastened to said first section of the base.

* * * * *